US007007436B1

(12) United States Patent
Kelley

(10) Patent No.: US 7,007,436 B1
(45) Date of Patent: Mar. 7, 2006

(54) SNAP-IN-PLACE BUILDING BLOCK

(76) Inventor: Jay R. Kelley, 9022 Marsh Mount Rd., Pinson, AL (US) 35126

( * ) Notice: Subject to any disclaimer, the term of this patent is extended or adjusted under 35 U.S.C. 154(b) by 0 days.

(21) Appl. No.: 11/033,512

(22) Filed: Jan. 12, 2005

(51) Int. Cl.
*E04C 2/04* (2006.01)

(52) U.S. Cl. ..... 52/605; 52/309.7; 52/565

(58) Field of Classification Search ..... 52/309.7, 52/309.16, 604–606, 612, 600, 589.1, 590.2, 52/590.1, 565
See application file for complete search history.

(56) References Cited

U.S. PATENT DOCUMENTS

| | | | | |
|---|---|---|---|---|
| 869,770 | A * | 10/1907 | Birnstock | 52/125.4 |
| D220,622 | S | 5/1971 | Passander | |
| 3,618,279 | A | 11/1971 | Sease | |
| 3,782,049 | A | 1/1974 | Sachs | |
| 3,788,020 | A * | 1/1974 | Gregori | 52/309.12 |
| 3,888,060 | A | 6/1975 | Haener | |
| 3,982,369 | A * | 9/1976 | Keleske | 52/309.12 |
| D243,855 | S | 3/1977 | Hynes | |
| 4,031,678 | A | 6/1977 | Schuring | |
| 4,223,501 | A * | 9/1980 | DeLozier | 52/309.12 |
| 4,258,522 | A | 3/1981 | Amaral | |
| 4,297,816 | A | 11/1981 | Kella et al. | |
| 4,426,815 | A | 1/1984 | Brown | |
| 4,651,485 | A | 3/1987 | Osborne | |
| 4,879,855 | A * | 11/1989 | Berrenberg | 52/309.11 |
| 4,894,969 | A | 1/1990 | Horobin | |
| 5,379,565 | A | 1/1995 | Vienne | |
| 5,457,926 | A * | 10/1995 | Jensen | 52/604 |
| D377,397 | S | 1/1997 | Craig | |
| D387,431 | S | 12/1997 | Tremblay | |
| 5,709,060 | A * | 1/1998 | Vaughan et al. | 52/426 |
| 5,802,797 | A * | 9/1998 | Storer-Folt | 52/604 |
| 5,901,520 | A | 5/1999 | Abdul-Baki | |
| 6,131,365 | A | 10/2000 | Crockett | |
| 6,134,853 | A | 10/2000 | Haener | |
| 6,138,426 | A | 10/2000 | Mork et al. | |
| 6,308,491 | B1 | 10/2001 | Porter | |
| 6,434,900 | B1 | 8/2002 | Masters | |

(Continued)

FOREIGN PATENT DOCUMENTS

| | | |
|---|---|---|
| FR | 2 562 932 A1 | 10/1985 |
| FR | 2 577 255 A1 | 8/1986 |
| JP | 2-43437 | 2/1990 |

OTHER PUBLICATIONS

"Insulated concrete forms," Concrete Homes Magazine.Com; available at: http://www.concretehomesmagazine.com/issues/2002/07/building.shtml; 5 pages, printed Nov. 16, 2004.

(Continued)

*Primary Examiner*—Naoko Slack

(57) ABSTRACT

The snap-in-place building block has two internal support brackets constructed from durable plastic that are equipped with male and female interlocking devices, a rebar clip, a furring strip, and exterior flanges that are molded into a block body made from foamed plastic. A body of foamed plastic is molded around the brackets, the body defining two hollow cores, one bracket being disposed in each of the cores. A horizontal channel is formed between adjacent blocks when stacked above each other. The cores and horizontal channels receive concrete or mortar that forms vertical columns and horizontal beams within the wall. An exterior veneer is attached to the protruding exterior flanges on one side of the building block. The configuration of the block may be altered to allow for half-blocks and corner blocks.

6 Claims, 17 Drawing Sheets

U.S. PATENT DOCUMENTS

| | | | | |
|---|---|---|---|---|
| 6,640,514 | B1 * | 11/2003 | Guibert et al. | 52/592.1 |
| 6,722,094 | B1 | 4/2004 | Judd et al. | |
| 6,735,913 | B1 | 5/2004 | Sanders et al. | |
| 2001/0032431 | A1 | 10/2001 | Grinhpun et al. | |
| 2002/0007610 | A1 | 1/2002 | Abang et al. | |
| 2002/0043038 | A1 | 4/2002 | Cerrato | |
| 2004/0020155 | A1 | 2/2004 | Correa et al. | |
| 2004/0040245 | A1 | 3/2004 | Sinclair, Sr et al. | |
| 2004/0134154 | A1 | 7/2004 | Bott | |
| 2004/0221538 | A1 | 11/2004 | Thorpe | |

OTHER PUBLICATIONS

"Smart Block," Smart Block.Com; available at: http://www.smartblock.com/; 2 pages, printed Nov. 16, 2004.

"i-Form Flat Wall Construction" Reward Walls.Com; available at: http://www.rewardwalls.com/productoverview/iform_01.shtml; 1 page, printed Nov. 16, 2004.

"Durisol Building System," Durisol Build.Com; available at: http://www.durisolbuild.com/4-System.html; 1 page, printed Nov. 16, 2004.

* cited by examiner

SNAP-IN-PLACE BUILDING BLOCK

BACKGROUND OF THE INVENTION

1. Field of the Invention

The present invention relates to building materials, and particularly to a snap-in-place building block with a molded in place exterior veneer that can self-level and self-plumb.

2. Description of the Related Art

Walls for homes, schools, hospitals and other residential and commercial buildings are constructed from a variety of materials, such as wood, brick, synthetic materials, stone and concrete blocks. Concrete block construction is conventionally done with hollow cored cement masonry units ("CMU's"). The CMU's are typically sealed in place with mortar so that the hollow cores of the CMU's face upwards. The hollow cores are sometimes filled with insulation, concrete, rebar, or some other type of filler.

In concrete block construction, a foundation is laid and then a row, called a "course," of concrete blocks are set in mortar on the foundation. Another layer of mortar is placed on top of the fist course and a second course is then laid. In this manner a block wall is constructed, but to achieve a block wall that is both level and plumb, a great deal of time and skill is required. The time and skill required to build a concrete block wall raises construction costs. Another problem with concrete block walls is that in their unfinished state they do not present a very pleasant appearance and therefore require finishing. Finishing a concrete block wall usually involves attaching a veneer, or painting, applying stucco, or attaching some other type of siding system. The finishing of a concrete block wall also requires considerable skill and can add substantial cost to construction.

Several devices have been put forward to address some of the problems in block wall construction. A variety of interlocking blocks have been suggested to eliminate the need for mortar and to self-level and self-plumb block walls. Most of the interlocking blocks contain grooves and protrusions that fit together. This has not been found to be an effective solution for concrete blocks because the grooves and protrusions cannot be formed to precise enough tolerances during manufacturing. That means the blocks must be modified by hand, which greatly detracts from their cost effectiveness. The problem of adding siding or veneers to building blocks has also not been adequately addressed. Block wall systems exist that may have veneers or siding attached, but none currently exist that have an exterior veneer integrated into the block itself. Thus, a snap-in-place building block solving the aforementioned problems is desired.

SUMMARY OF THE INVENTION

The snap-in-place building block incorporates several features into a single building block that reduces the time and cost of constructing a wall. The snap-in-place building block has three primary components. The first component is two internal support brackets constructed from durable plastic that are equipped with male and female interlocking devices, a rebar clip, a furring strip, and exterior flanges for the attachment of a veneer.

The second component is the body of the snap-in-place building block, which is made from closed-cell insulation, such as expanded polystyrene, urethane or other foamed plastics. The overall shape of the body of the snap-in-place building block resembles a standard cement masonry unit, having a top, a bottom, two sidewalls, two end walls, and two hollow cores separated by a center wall. When the body of the snap-in-place building block is molded, the body is molded with one internal support bracket placed across the width of each hollow core. The internal support brackets are placed across each hollow core so that the furring strip lies below the surface of one sidewall and the exterior flanges protrude from the surface of the opposite sidewall. On the top and bottom of each building block is a horizontal channel between each sidewall running the length of the building block. Of the two end walls on each snap-in-place building block, one end wall is equipped with a female joint and the other end wall is equipped with a male joint to make the building blocks interlocking end-to-end. Similarly, the top and bottom of each building block is interlocking. The top of each sidewall has a protruding lip that corresponds to a groove molded into a groove in the bottom of each sidewall. The top and bottom of the internal support bracket is also equipped with male and female interlocking devices, respectively.

The third component of the snap-in-place building block is a veneer attached to the protruding exterior flanges on one side of the building block. The exterior veneer may be regular concrete, lightweight concrete, cement, or similar materials that may simulate the appearance of brick, rock, stone, slate, marble and other siding materials. To counteract the weight of the exterior veneer, a counterweight may be embedded into the opposite sidewall between the furring strips.

The only skilled labor involved in the erection of a wall using the snap-in-place building block is in the laying of a level foundation. Once a foundation is laid, the snap-in-place building blocks are laid in rows, or courses. Because the snap-in-place building blocks are interlocking, they self-level and self-plumb as the wall is being constructed. The rebar clips in the internal support bracket allow rebar to be laid horizontally as each course is laid down. After four or five courses of snap-in-place building blocks have been laid, the builder then pours concrete into the hollow cores of the uppermost course. The concrete filters through both the hollow cores and the horizontal channels in each snap-in-place building block. In this manner both vertical columns and horizontal beams of concrete are formed. The builder may also add rebar in to the hollow cores for further reinforcement.

By constructing the body of the snap-in-place building block out of foamed plastic, the body acts both as thermal insulation and as a vapor barrier, thereby eliminating the high costs of wall insulation. The snap-in-place building block is intended to be used so that the veneer faces outward to the environment. The interior side of the block is equipped with a furring strip that acts as a wall stud for the attachment of an interior wall system.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
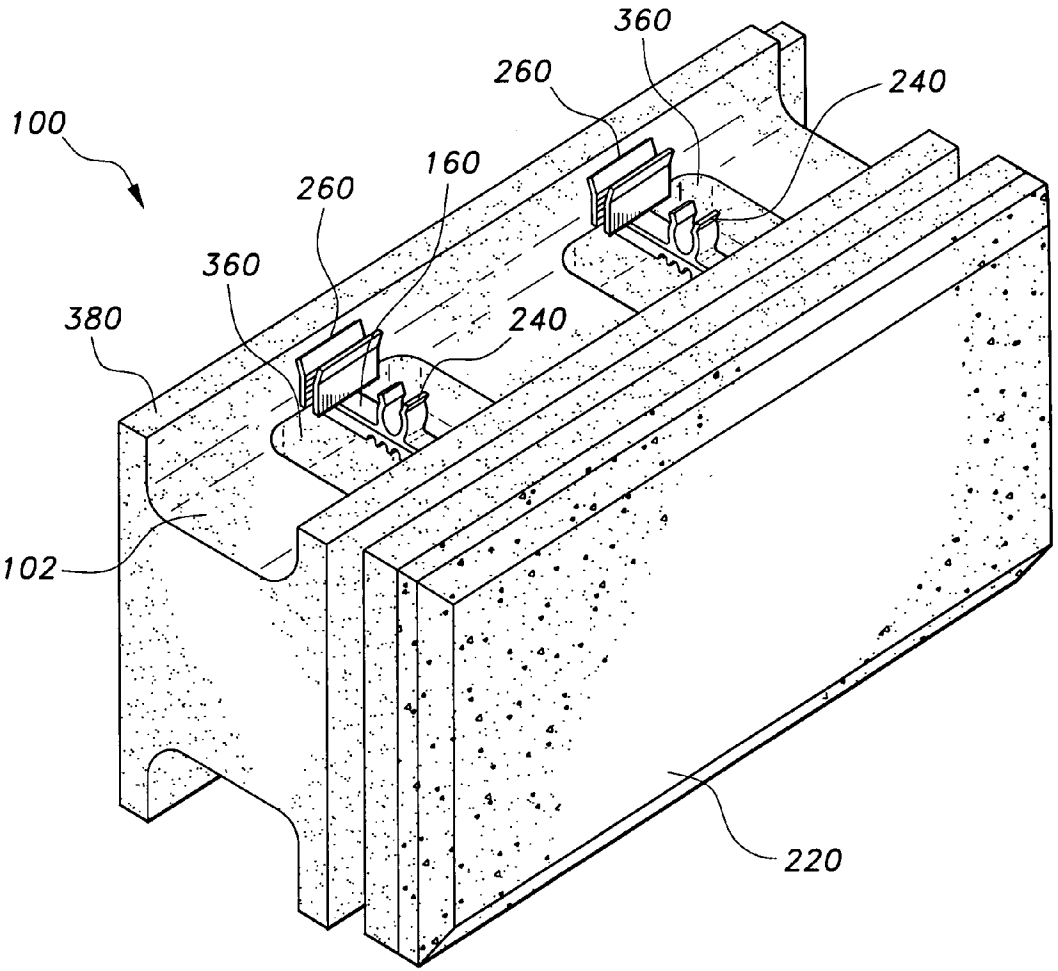
FIG. 1 is a perspective view of a snap-in-place building block according to the present invention.
Figure 11:
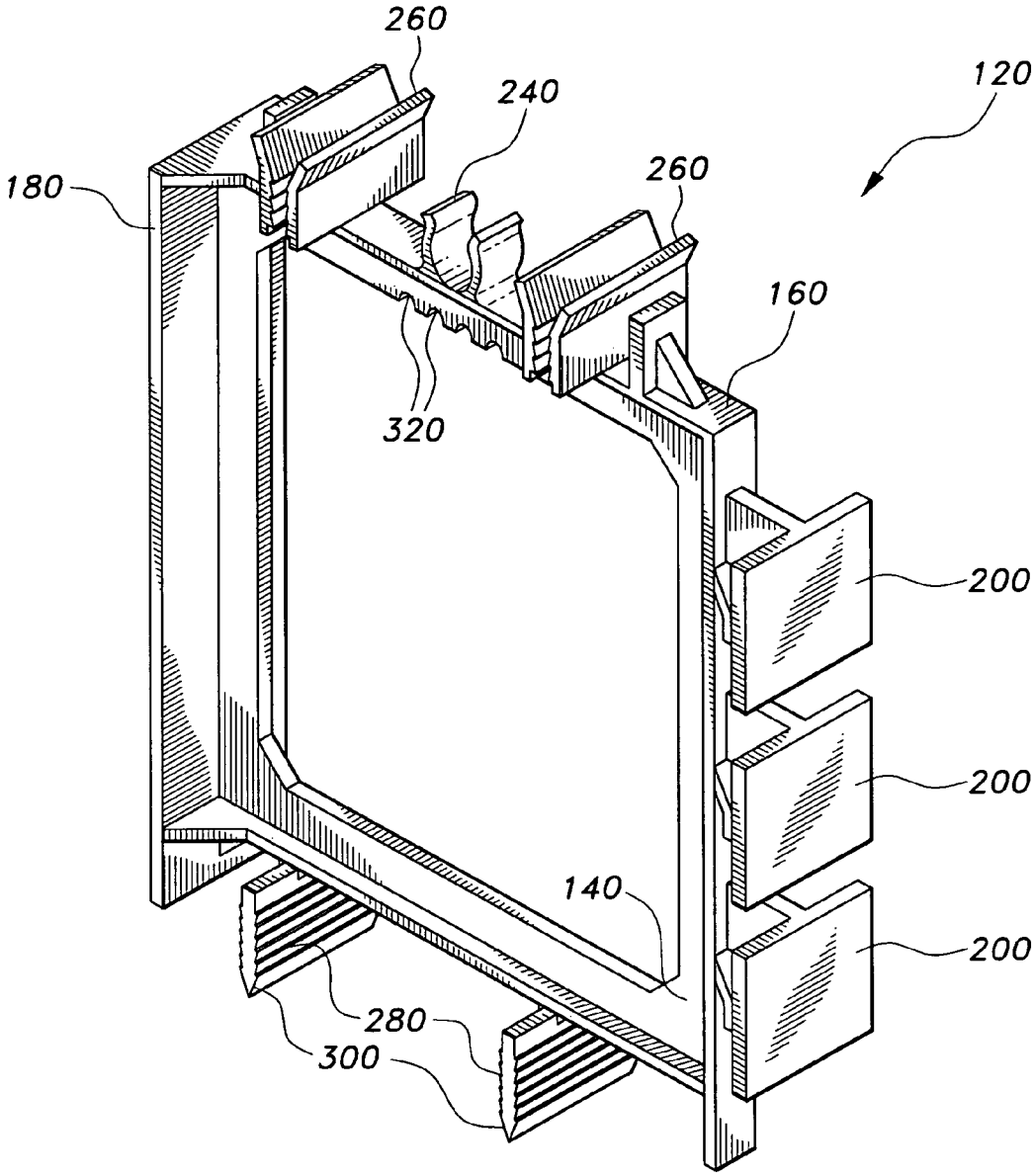
FIG. 11 is a perspective view of an internal support bracket.
Figure 12:
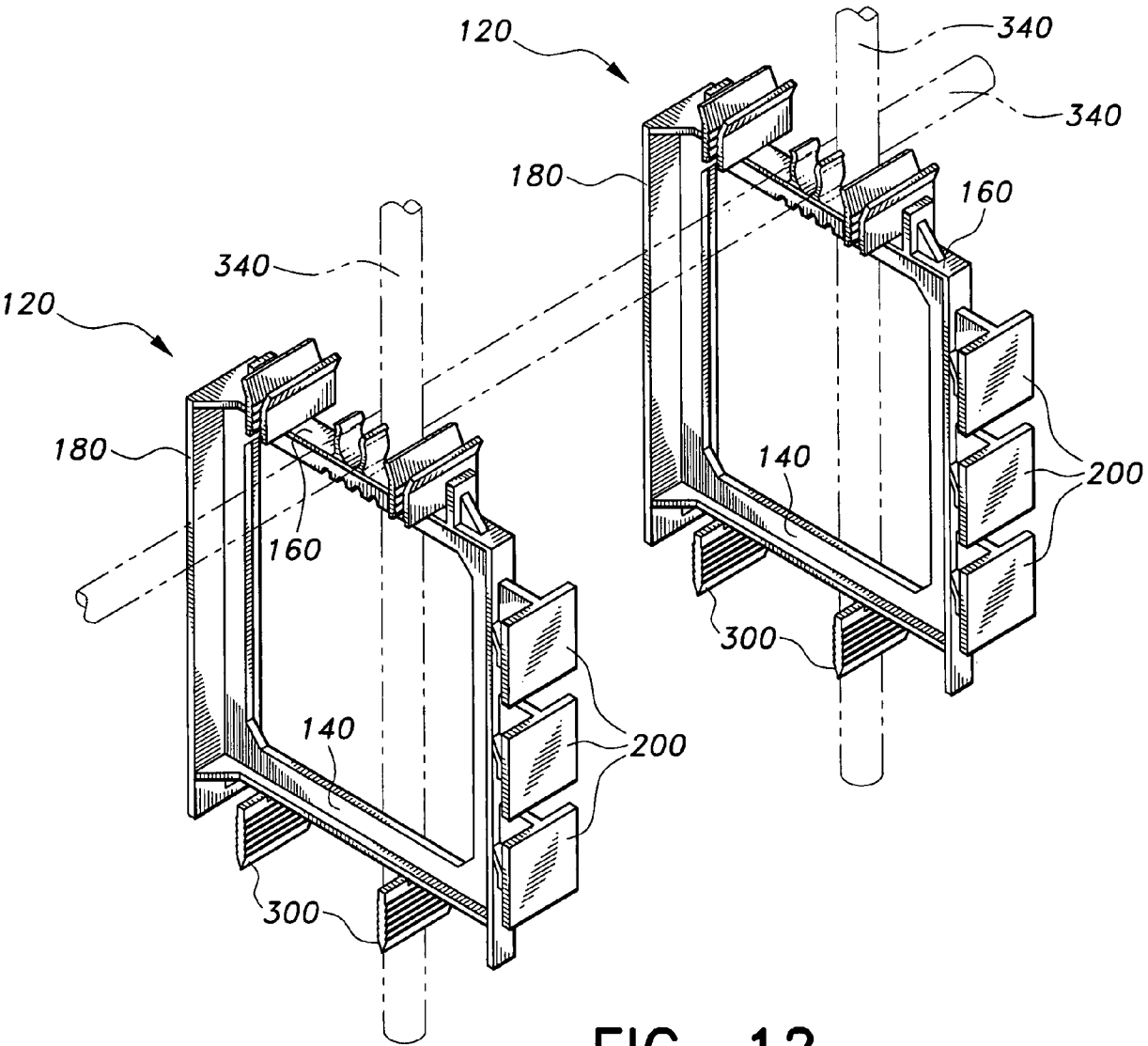
FIG. 12 is a perspective view of internal support brackets and the horizontal and vertical rebar placement in relation to each other as they appear inside the block wall.

The present invention is a snap-in-place building block, designated generally as 100 in the drawings, also referred to herein as a "building block." FIG. 1 shows a perspective view of the snap-in-place building block 100. The snap-in-place building block 100 is made up of several components to form a single unit as shown in FIG. 1. The first of the components making up the snap-in-place building block 100 is an internal support bracket, designated generally as 120 and shown in a perspective view in FIGS. 11 and 12, and in greater detail in FIGS. 10A–F.

The internal support bracket 120 is made of durable plastic, preferably by injection molding. The internal support bracket 120 comprises a generally rectangular open frame 140 surrounded by a flange 160. The flange 160 has a top, bottom, right side and left side. The left side of the flange 160 is wider than the other three sides of the flange 160 and forms a furring strip 180 that acts as a wall stud for the attachment of gypsum board or other wall coverings. Along the right side of the flange 160 are three exterior reinforcing flanges 200 that support the exterior veneer 220. On the top of the flange 160 is a medially located rebar clip 240 designed to secure in place a segment of rebar 340 having a standard diameter. Also on the top of the flange 160 are two female interlocking devices 260, one on each side of the rebar clip 240. The female interlocking devices 260 are shaped like a clip and have barbs 280. On the bottom of the flange 160 are two male interlocking devices 300, shaped like a tab, that are also equipped with barbs 280. One further feature of the internal support bracket 120 is a series of rebar tie-wire notches 320 positioned on the interior edge of the top portion of the frame 140. The rebar tie-wire notches 320 are to secure wire used to tie rebar 340 that is laid vertically to the horizontally laid rebar 340 in the rebar clips 240.

Figure 2D:
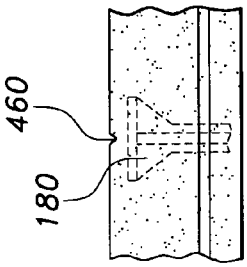
FIG. 2D is a fragmented view of a furring strip for a snap-in-place block according to the present invention.
Figure 2C:
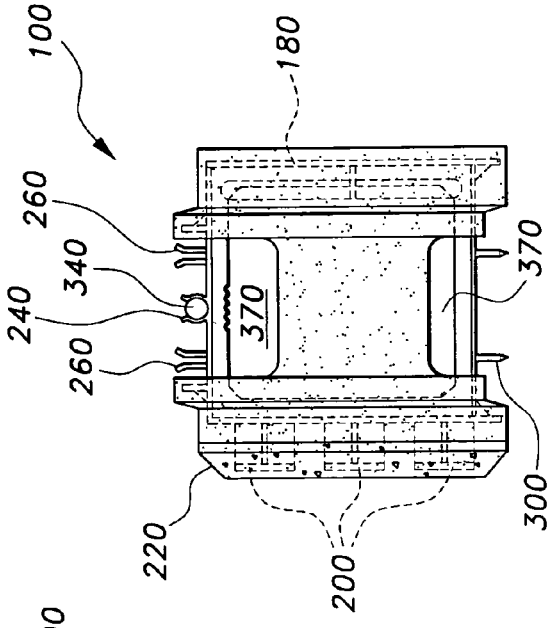
FIG. 2C is a right side view of the block of FIG. 2A.
Figure 2A:
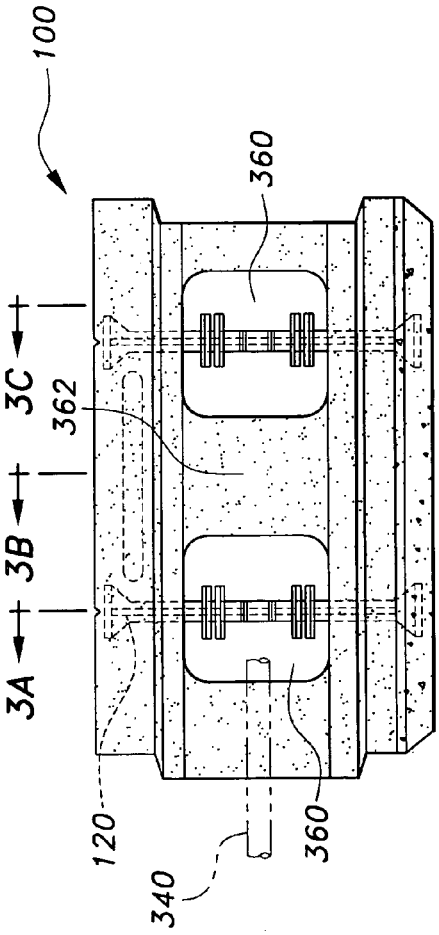
FIG. 2A is a plan view of a snap-in-place block according to the present invention.
Figure 2B:
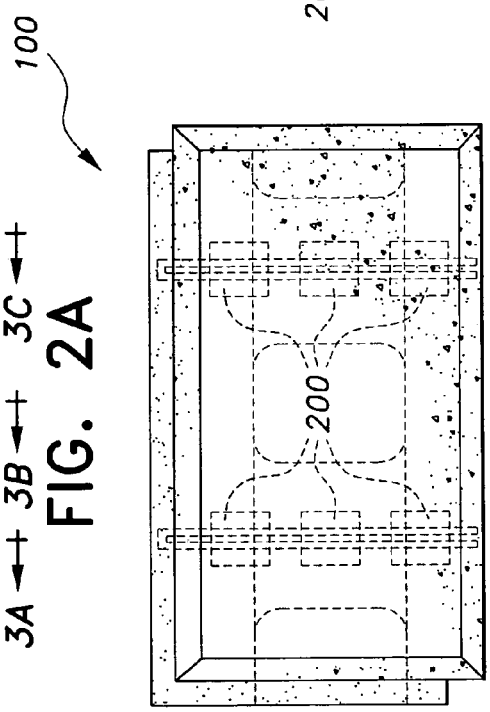
FIG. 2B is a right side view of the snap-in-place block of FIG. 2A.
Figure 3C:
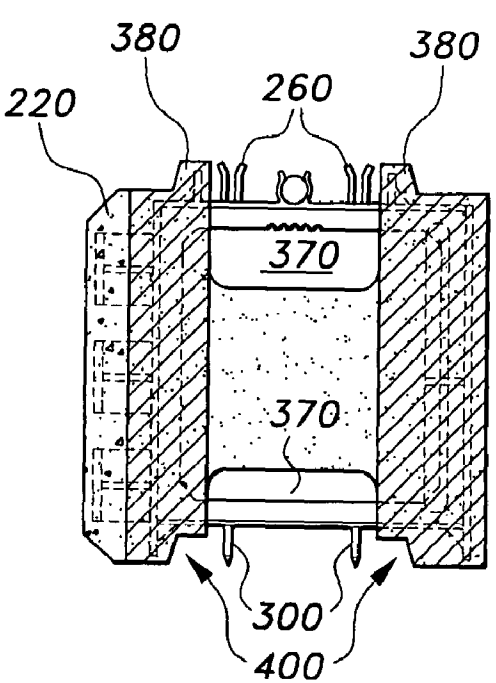
FIGS. 3A, 3B, and 3C are section views drawn along lines 3A—3A, 3B—3B, and 3C—3C, respectively, of FIG. 2A.
Figure 3B:
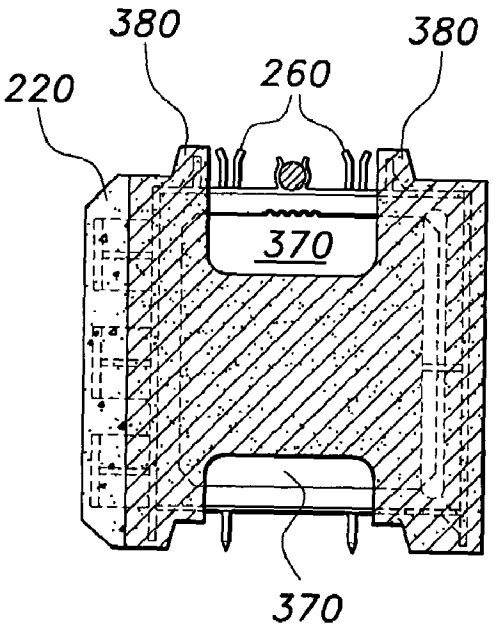
Figure 3A:
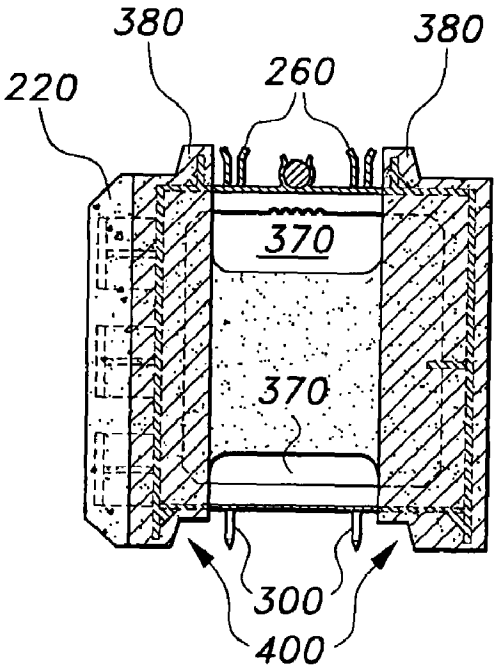
Figure 4:
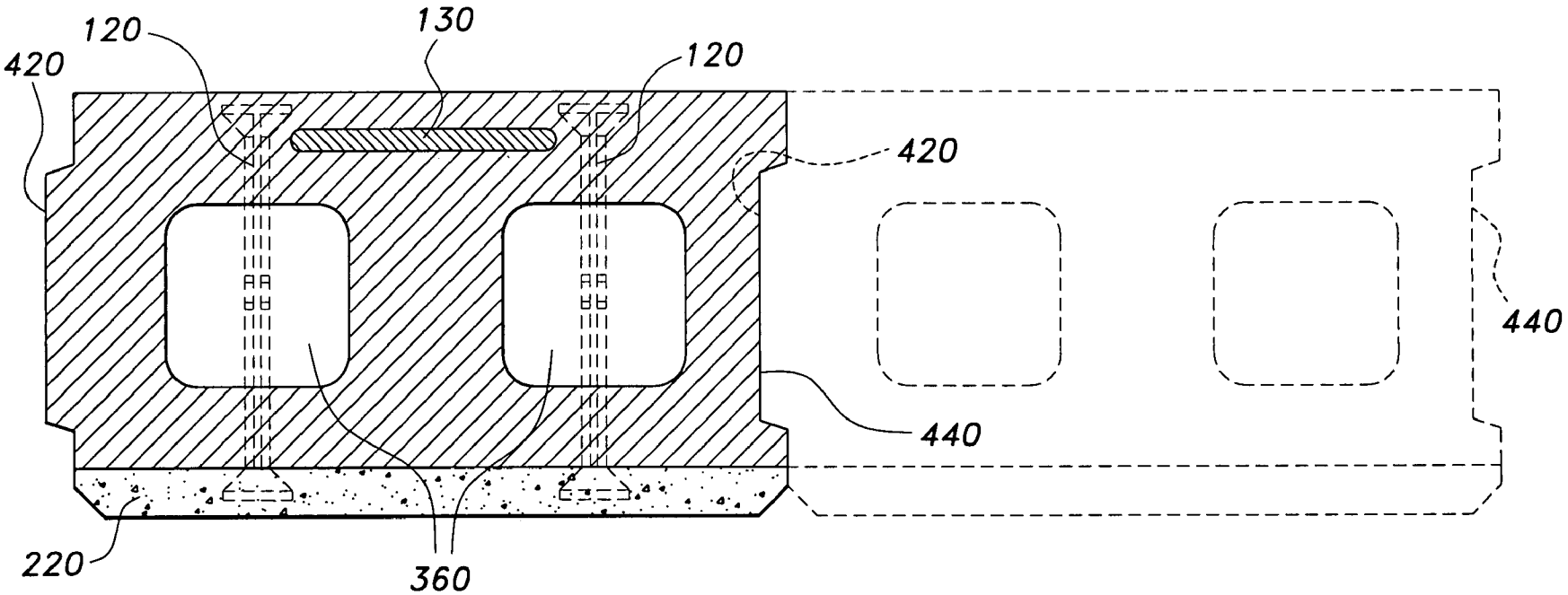
FIG. 4 is a plan view showing the interlocking male and female horizontal joint in the snap-in-place block.
Figure 5:
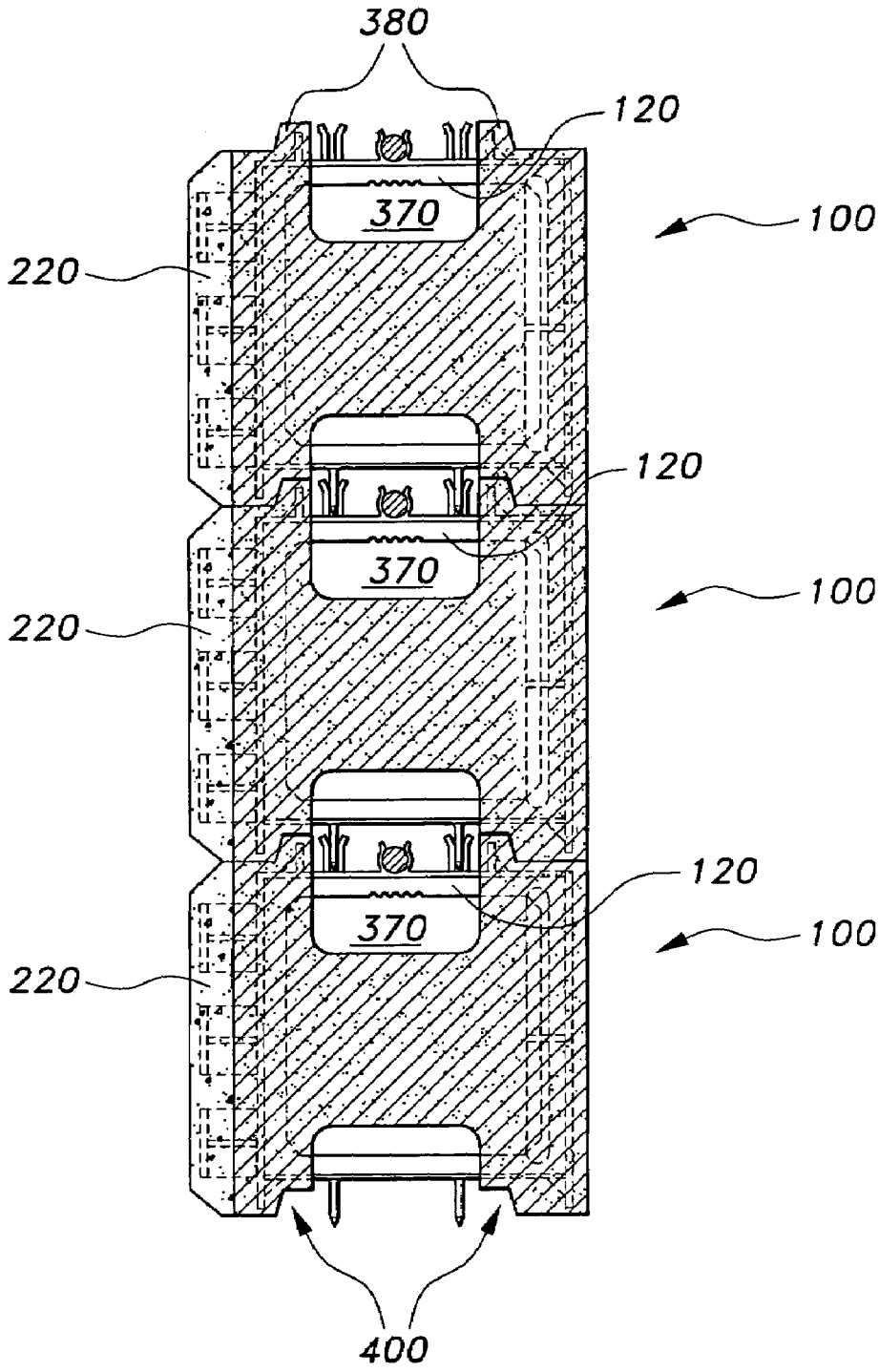
FIG. 5 is an end view of multiple snap-in-place blocks in a wall system, showing horizontal rebar placement.

The second component of the snap-in-place building block 100 is the body 102 of the snap-in-place building block. The body 102 of the snap-in-place building block 100 is made of closed-cell foamed plastic, such as expanded polystyrene, urethane or other foamed plastics, which also provides insulation. The overall shape of the body 102 of the snap-in-place building block 100 resembles a standard cement masonry unit having a top, a bottom, two sidewalls, two end walls, and two hollow cores 360 separated by a breaker or center wall 362. When the body 102 of the snap-in-place building block 100 is molded, the body 102 is molded with one internal support bracket 120 placed across the width of each hollow core 360, as shown in detail in FIGS. 2A–D and 3A–C. The internal support brackets 120 are placed across each hollow core 360 so that the furring strip 180 lies below the surface of one sidewall and the exterior flanges 200 protrude from the surface of the opposite sidewall. On the top and bottom of each snap-in-place building block 100 is a horizontal channel 370 extending between the sidewalls and extending the length of the building block 100. On the top of the building block 100, the sidewalls extend upwards, forming a lip 380 along the upper surface of the building block 100. On the bottom of the building block 100, the sidewalls are recessed, forming a groove 400 that the lip 380 fits into when building blocks 100 are stacked on top of each other. In addition to the lip 380 and groove 400 fitting together, courses of building blocks 100 are also held in place by the male and female interlocking devices 260, 300. Referring to FIG. 4, a single course of building blocks 100 is held in horizontal alignment by a protruding male joint 420 along the left end wall of the building block 100 and an indented female joint 440 along the right end wall of the building block 100. FIG. 4 demonstrates how a course of building blocks 100 is horizontally aligned by inserting the male joint 420 into the female joint 440. FIG. 5 demonstrates how the a stack of building blocks 100 are held in vertical alignment using the combination of male and female interlocking devices 260, 300 and the lip 380 and groove 400 arrangement. Another feature of the body 102 of the snap-in-place building block 100 is a counterweight 130 embedded in to the sidewall opposite the exterior veneer 220. Because the body 102 of the snap-in-place building block 100 is made of lightweight foamed plastic, the counterweight 130 is necessary to balance the weight of the exterior veneer 220. Still another feature of the body 102 of the snap-in-place building block 100 is a centerline notch 460 (shown in FIG. 2D) cut into the surface of the sidewall in alignment with the center of the furring strip 180. Because the furring strip 180 acts as a wall stud, the centerline notch 460 is helpful to easily locate the position of the furring strip 180 for the attachment of interior wall systems.

The third component of the snap-in-place building block 100 is an exterior veneer 220. When the body 102 of the snap-in-place building block 100 is initially formed, the exterior reinforcing flanges 200 protrude from the surface of the body 102. The exterior veneer 220 is then molded onto the outer surface of the body 102 on one sidewall. Exterior veneer 220 may be constructed of regular cement, lightweight cement, concrete, plastics or other materials to simulate the appearance of brick, stone, slate, marble, stucco or other materials. It is contemplated that the exterior veneer 220 can come in a variety of colors and alternate designs.

Figure 7B:
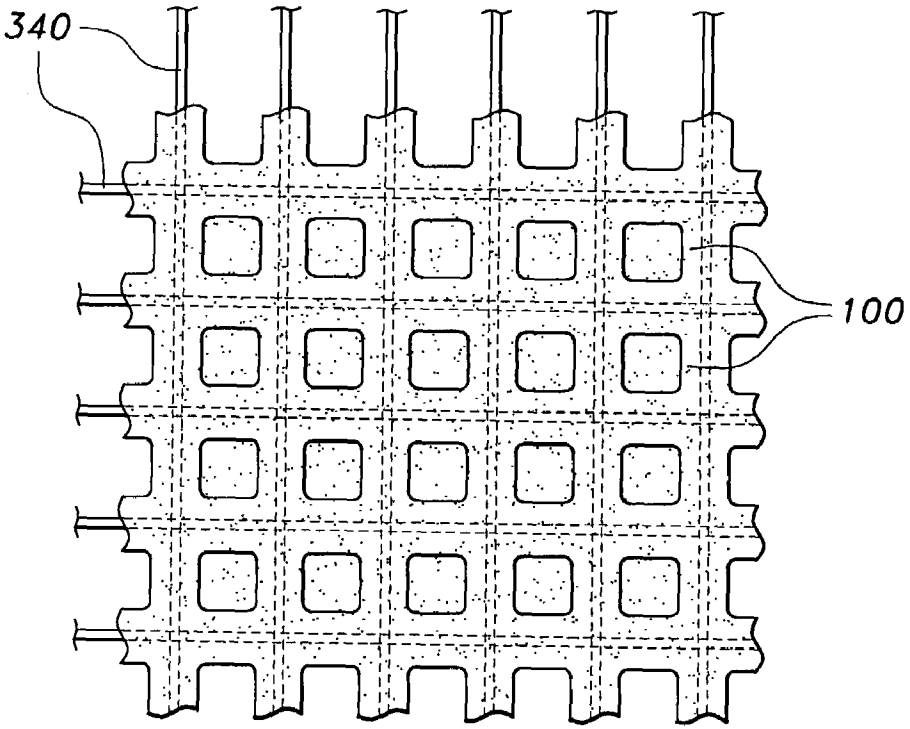
FIG. 7B is a front elevation view of a non-staggered block wall section showing the concrete and rebar forming horizontal beams and vertical columns on the interior of the blocks during construction.
Figure 7A:
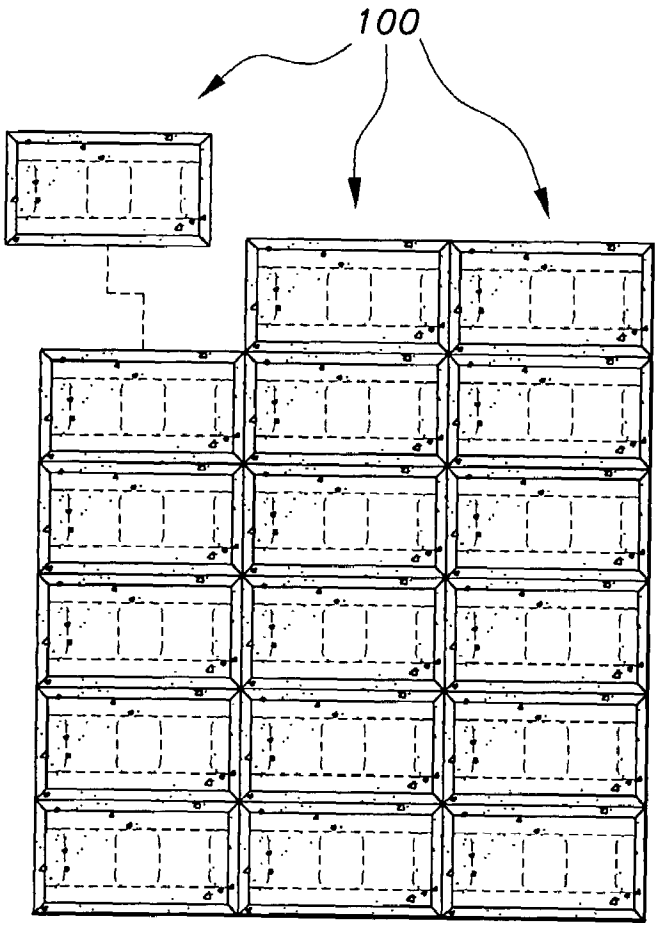
FIG. 7A is a front elevation view of a non-staggered block wall section.
Figure 9B:
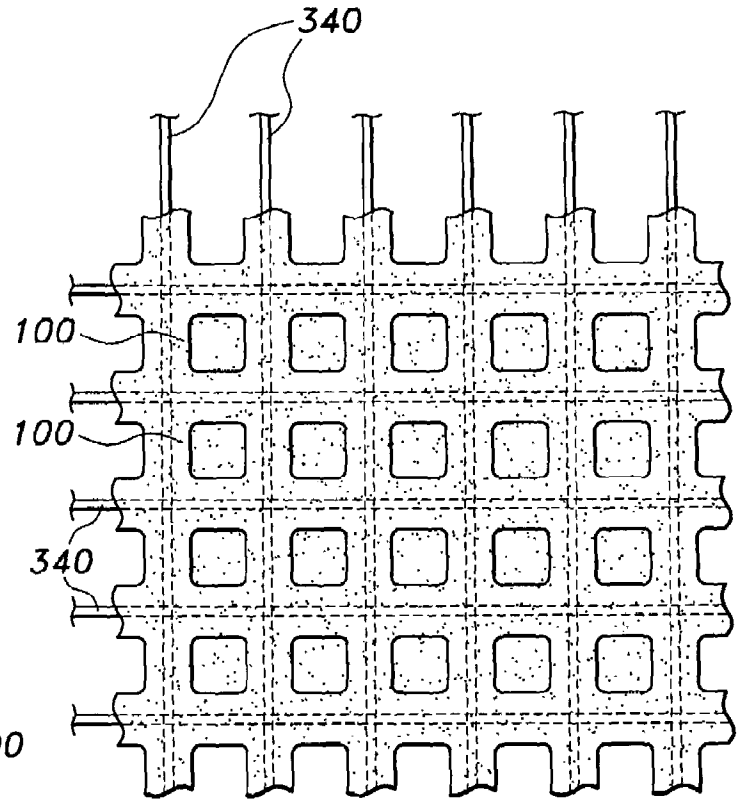
FIG. 9B is a front elevation view of a staggered block wall section showing the concrete and rebar forming horizontal beams and vertical columns on the interior of the blocks during construction.
Figure 9A:
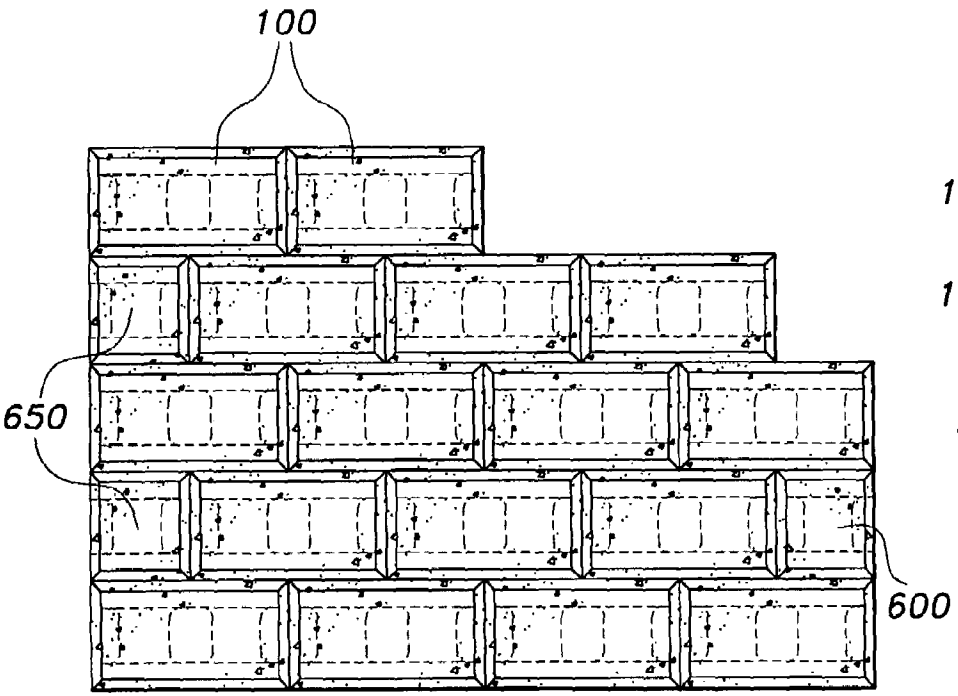
FIG. 9A is a front elevation view of a staggered block wall section.
Figures 10A, 10B, 10C, 10D, 10E:
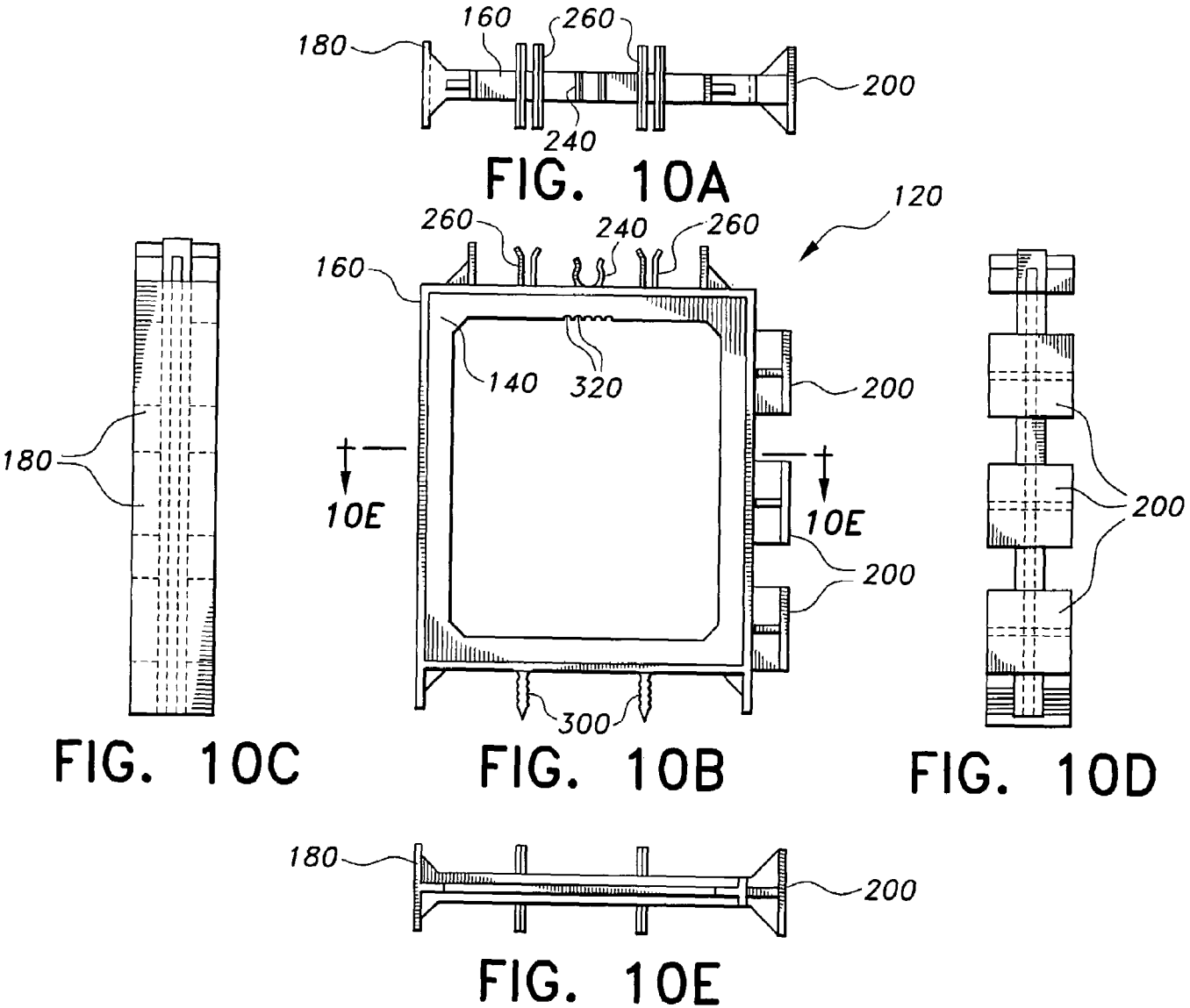
FIGS. 10A, 10B, 10C and 10D are plan, front, left side and right side views, respectively, of an internal support bracket.
FIG. 10E is a section view drawn along lines 10E—10E of FIG. 10B.
Figure 10F:
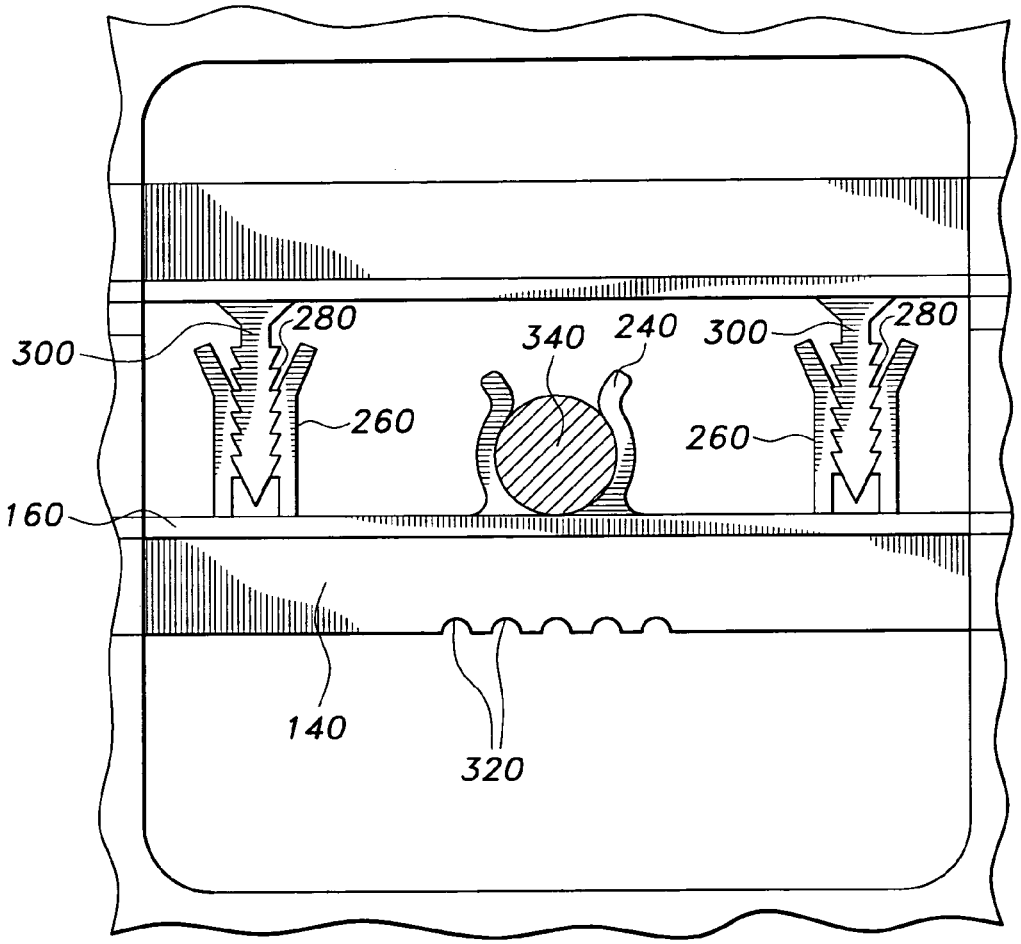
FIG. 10F is an elevation showing the snap-in-place male and female interlocking device and rebar alignment tabs.

Erecting a wall using snap-in-place building blocks 100 greatly simplifies wall construction. The only skilled labor involved in the erection of a wall using the snap-in-place building block 100 is in the laying of a level foundation. Once a foundation is laid, the snap-in-place building blocks 100 are laid in rows, or courses. Because the snap-in-place building blocks 100 are interlocking, they self-level and self-plumb as the wall is being constructed. The rebar clips 240 in the internal support bracket 120 allow rebar to be laid horizontally as each course is laid down. For exemplary purposes only, after a builder has laid down four or five courses of snap-in-place building blocks 100, the builder then pours concrete, or another type of mortar, into the hollow cores of the upper most course. The concrete filters through both the hollow cores 360 and the horizontal channels 370 in each snap-in-place building block 100. In this manner both vertical columns and horizontal beams of concrete are formed inside the wall. The builder may also add rebar 340 vertically into the hollow cores for further reinforcement. The rebar 340 is inserted into the hollow cores 360 before the concrete is poured and wired to the horizontally laid rebar 340. FIGS. 7A–B and 9A–B show the placement of rebar 340 for both a non-staggered block wall (as shown in FIGS. 7A–B) and for a staggered block wall (as shown in FIGS. 9A–B), respectively. The vertical rebar is held in the proper position by tying the wire through rebar tie-wire notches 320 located on the internal support bracket 120.

Figure 6:
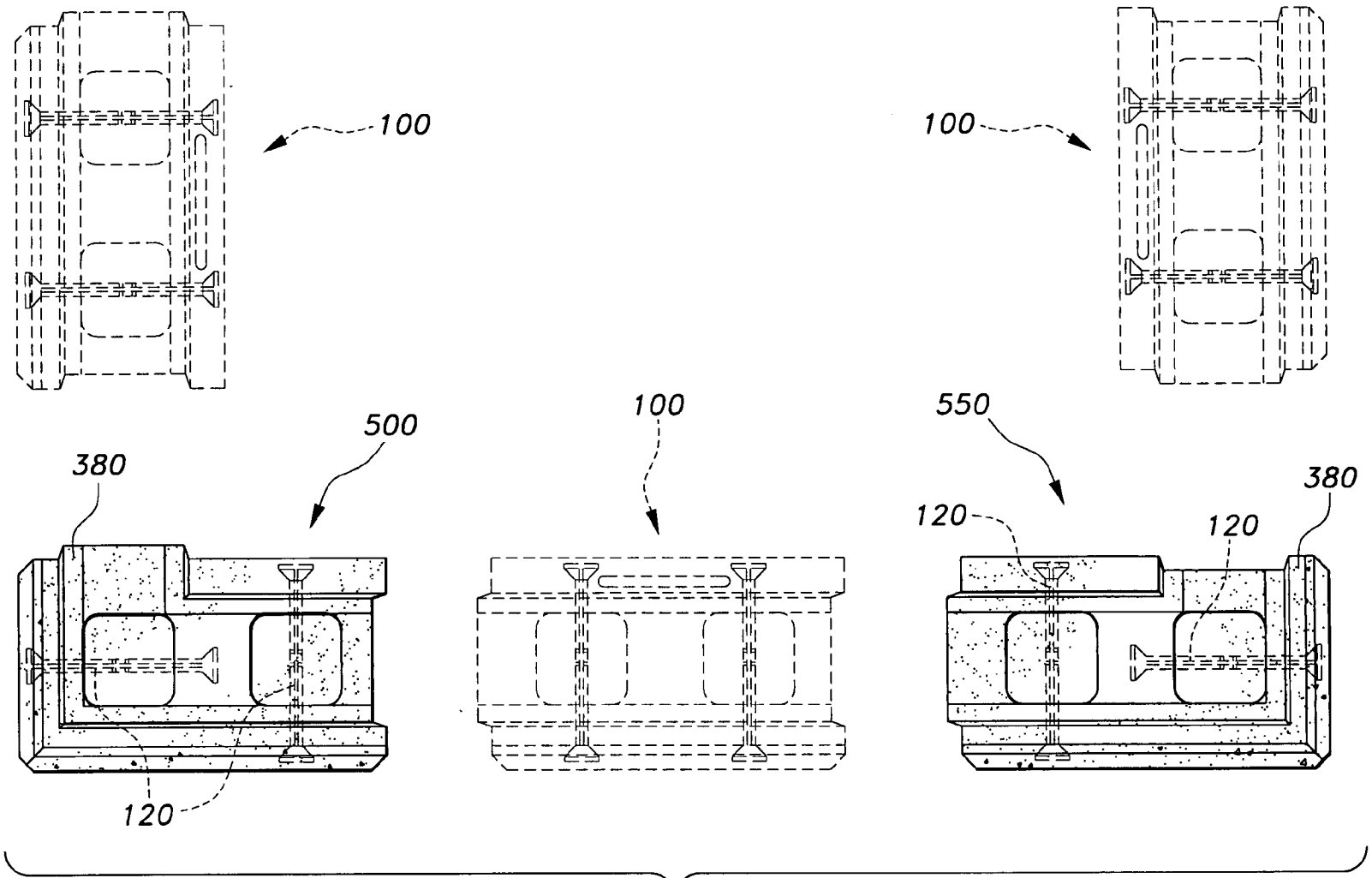
FIG. 6 is a plan view showing snap-in-place blocks adapted for use in corners.
Figure 8:
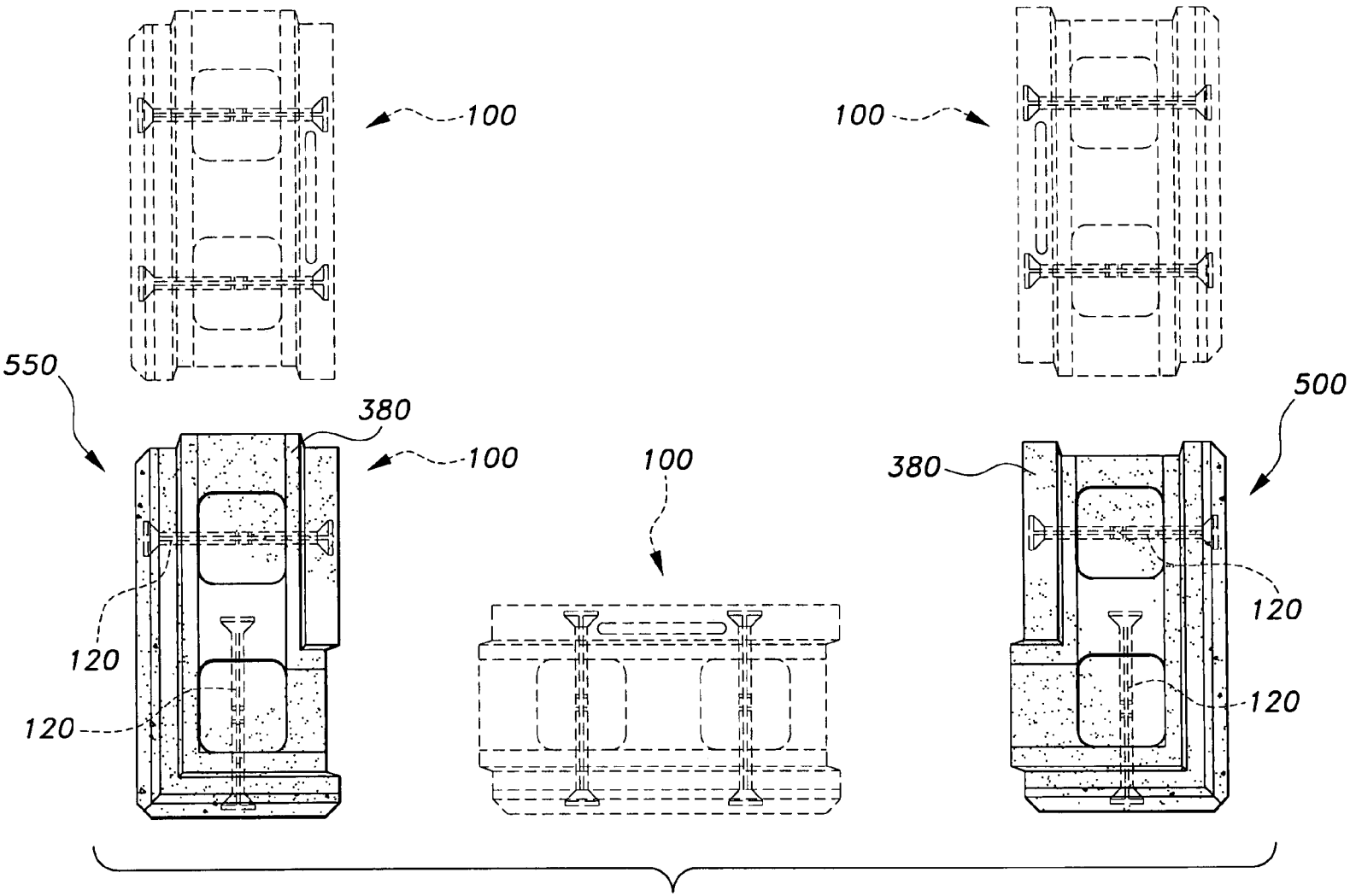
FIG. 8 is a plan view showing the placement of a male and female corner block in a staggered block wall system.
Figure 14C:
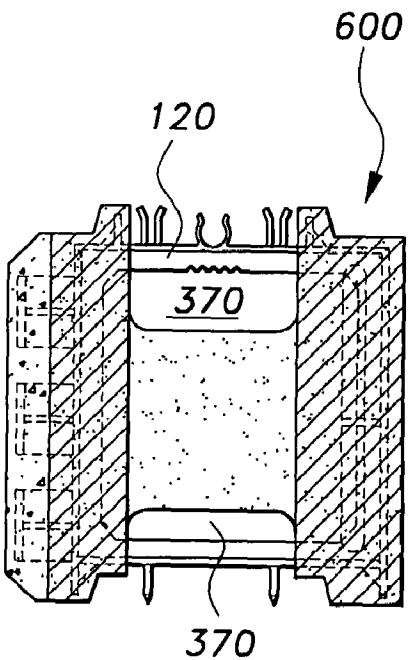
FIG. 14C is a section view drawn along line 14C—14C of FIG. 14A.
Figure 14B:
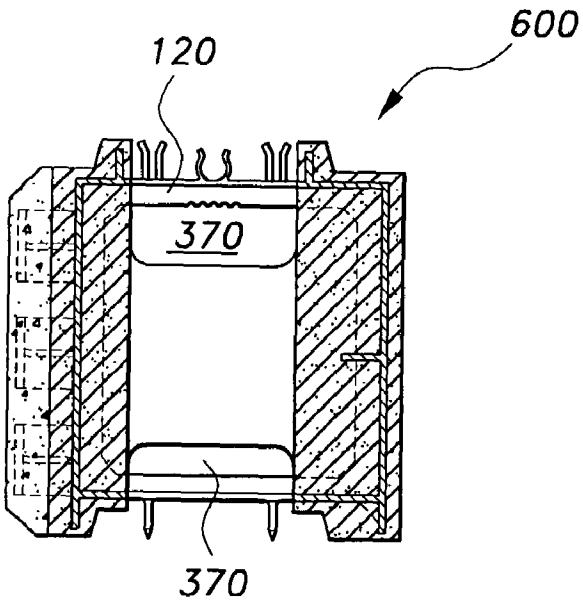
FIG. 14B is a section view drawn along line 14B—14B of FIG. 14A.
Figure 14A:
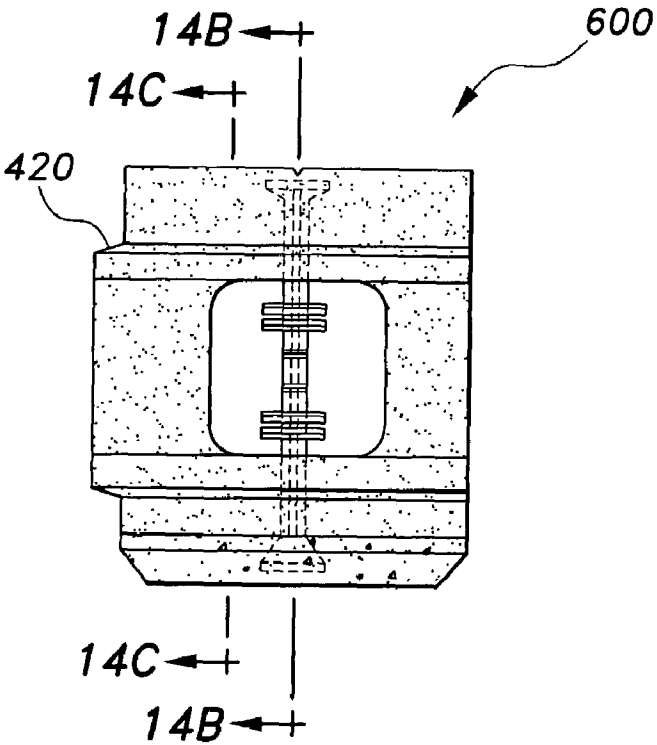
FIG. 14A is a plan view of a male half-block.
Figure 15C:
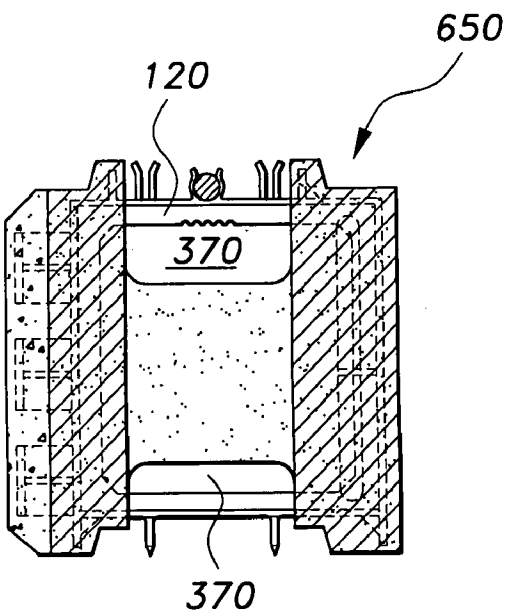
FIG. 15C is a section view drawn along line 15C—15C of FIG. 15A.
Figure 15B:
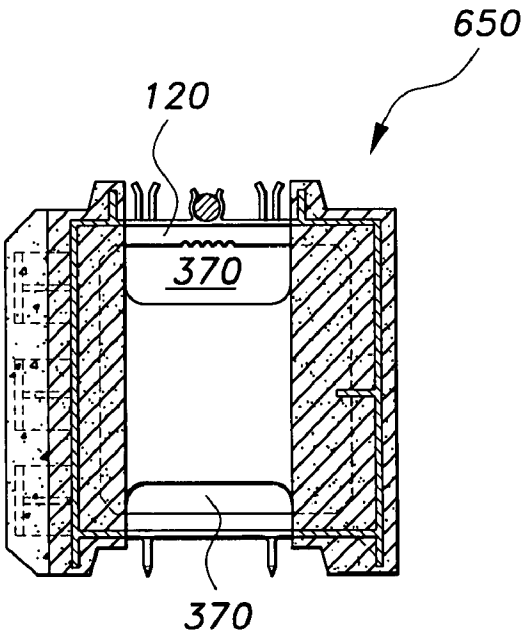
FIG. 15B is a section view drawn along line 15B—15B of FIG. 15A.
Figure 15A:
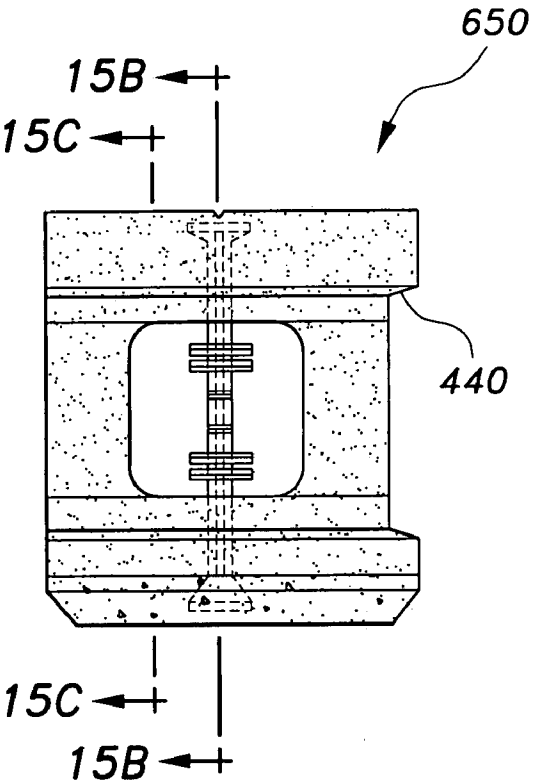
FIG. 15A is a plan view of a female half-block.
Figure 16A:
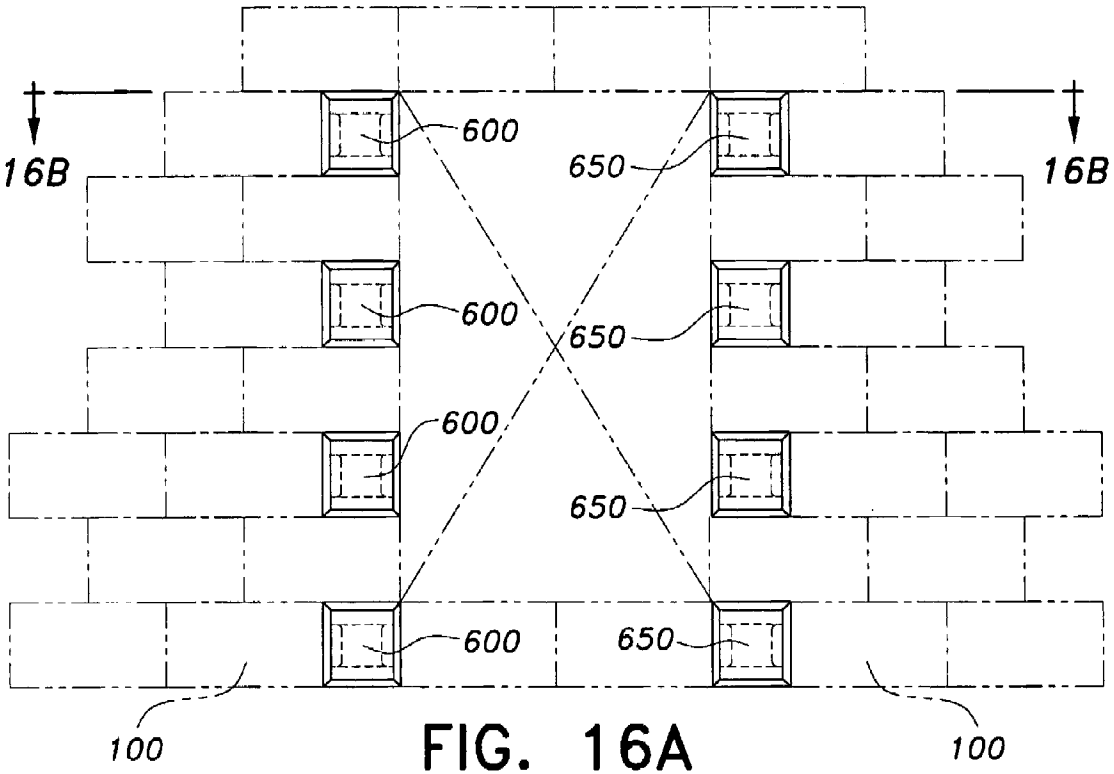
FIG. 16A is an elevation view of a block wall showing how male and female half-blocks are used to provide openings for doors or windows.
Figure 16B:
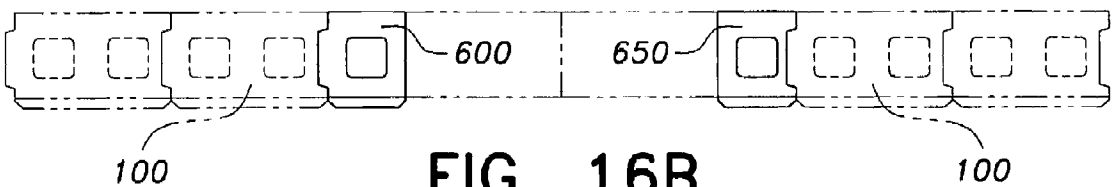
FIG. 16B is a section view along lines 16B—16B of FIG. 16A.

The present invention is not limited to the embodiment of the snap-in-place building block 100. As shown in FIGS. 6 and 8, the present invention includes male corner blocks 500 and female corner blocks 550 that are made by altering the orientation of the outward internal support bracket 120 to run lengthwise across the hollow core 360. The male and female interlocking devices 260, 300 and the lip 380 and groove 400 arrangement are similarly altered in a corner block to have an L-shape suitable for building on a corner. In situations where a corner block 500 may not be compatible with a particular building scenario, half-blocks are also contemplated. FIGS. 14A–C shows a male half-block 600 featuring a male joint 420. FIGS. 15A–C shows a female half-block 650 featuring a female joint 440. FIGS. 16A and 16B show both a male and female half-block 600, 650 built in to a block wall.

Figure 13A:
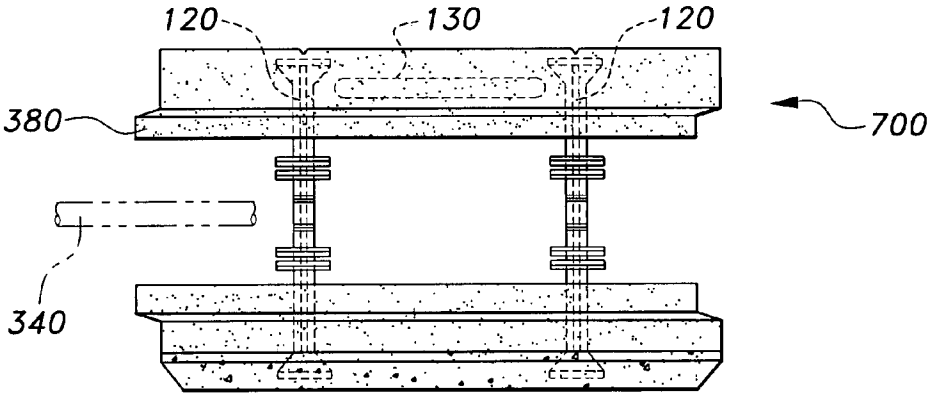
FIGS. 13A, 13B and 13C are plan, front, and right side views, respectively, of an open center snap-in-place block.
Figure 13B:
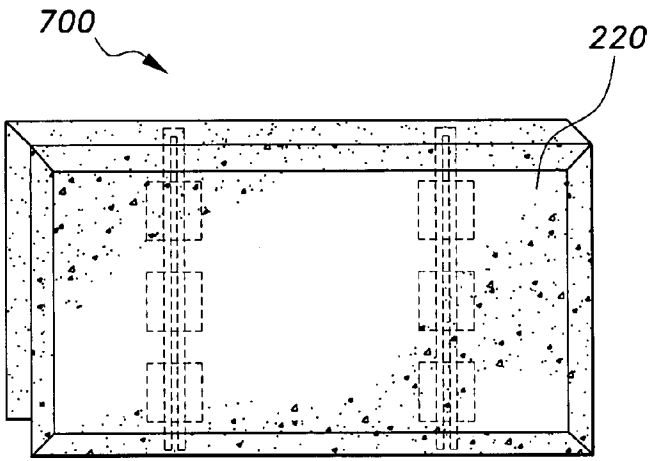
Figure 13C:
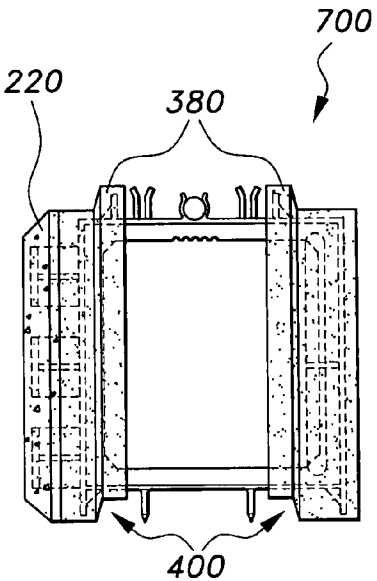

For situations where a builder may want a solid concrete wall rather than a wall having vertical columns and horizontal beams, the open-center building block 700 is shown in FIGS. 13A–C. The open-center building block 700 has two internal support brackets 120, two sidewalls, protruding lip 380, recessed groove 400, counterweight 130, and exterior veneer 220. The open-center building block 700 does not have end walls or a center wall. The two sidewalls are supported by the internal support bracket 120 only. In this manner, a builder who erects a wall using open-center building blocks 700 has only to pour concrete, or another type of mortar, into an uppermost course of open-center blocks 700 in order to have a wall with a solid concrete center.

By constructing the body of the different embodiments of the snap-in-place building blocks described above from foamed plastic, the body acts both as thermal insulation and as a vapor barrier, thereby eliminating the high costs of wall insulation. The snap-in-place building block is intended to be used so that the veneer 220 faces outward to the environment. The side of the block found on the interior is equipped with a furring strip 180 that acts as a wall stud for the attachment of an interior wall system.

It is to be understood that the present invention is not limited to the embodiments described above, but encompasses any and all embodiments within the scope of the following claims.

I claim:

1. A snap-in-place building block comprising:

a pair of parallel sidewalls having an upper surface and a lower surface, each of the upper surfaces having an upwardly and longitudinally extending lip and each of the lower surfaces having a longitudinally extending groove defined therein;

a first end wall extending between the sidewalls and defining an outwardly extending protrusion;

a second end wall extending between the sidewalls opposite the first end wall and defining an inward depression in opposition to the protrusion of the first end wall; and, an inner wall parallel to and equidistant from the two end walls defining a pair of generally rectangular hollow cores;

wherein the first end wall, second end wall and inner wall have an upper surface and lower surface inward from the upper surface and lower surface of the sidewalls defining a horizontal channel therein;

a pair of internal support brackets disposed medially in the hollow cores and parallel to the end walls, each of said internal support brackets comprising:

a generally rectangular open frame;

a peripheral flange having a top portion, a bottom portion, a left side portion and a right side portion, the peripheral flange extending about a periphery of the open frame, the left side portion having extended width to form a furring strip;

a rebar clip positioned on the top portion of the peripheral flange;

a female interlocking member on either side of the rebar clip, a pair of male interlocking members disposed on the bottom portion of the peripheral flange and positioned in alignment with the female interlocking members; and reinforcement flanges outwardly protruding from the right side portion of the peripheral flange.

2. The snap-in-place building block according to claim 1, wherein the snap-in-place building block is constructed of foamed plastic.

3. The snap-in-place building block according to claim 1, further comprising:

an exterior veneer attached to the protruding reinforcement flanges on the outward surface of the sidewall;

a centerline notch defined in an outward surface of the sidewall in alignment with the furring strip;

a plurality of barbs disposed along the inward surface of the female interlocking members; and, a plurality of barbs disposed along the outward surface of the male interlocking members.

4. A snap-in-place block, comprising:

a pair of parallel sidewalls having an upper surface and a lower surface, each of the upper surfaces having an upwardly and longitudinally extending lip and each of the lower surfaces having a longitudinally extending groove defined therein;

a first end wall and a second end wall extending between the sidewalls;

an inner wall parallel to and equidistant from the two end walls defining a pair of generally rectangular hollow cores; and, at least one internal support bracket disposed in between and perpendicular to the pair of parallel sidewalls;

said at least one internal support bracket comprising:

a generally rectangular open frame;

a peripheral flange having a top portion, a bottom portion, a left side portion and a right side portion, the peripheral flange extending about a periphery of the open frame, the left side portion having extended width to form a furring strip;

a rebar clip positioned on the top portion of the peripheral flange;

a female interlocking member on either side of the rebar clip;

a pair of male interlocking members disposed on the bottom portion of the peripheral flange and positioned in alignment with the female interlocking members; and reinforcement flanges outwardly protruding from the right side portion of the peripheral flange.

5. The snap-in-place block according to claim 4, wherein the snap-in-place block is constructed of foamed plastic.

6. The snap-in-place building block according to claim 4, further comprising:

an exterior veneer attached to the protruding reinforcement flanges on an outward surface of the sidewall;

a centerline notch defined in an outward surface of the sidewall in alignment with the furring strip;

a plurality of barbs disposed along the inward surface of the female interlocking members; and, a plurality of barbs disposed along the outward surface of the male interlocking members.

* * * * *